US006854369B2

(12) United States Patent
Allwein et al.

(10) Patent No.: US 6,854,369 B2
(45) Date of Patent: Feb. 15, 2005

(54) COMPRESSION-CUTTING ASSEMBLY AND METHOD

(75) Inventors: Robert J. Allwein, Littleton, CO (US); Blake B. Bogrett, Littleton, CO (US); Larry J. Weinstein, Littleton, CO (US)

(73) Assignee: Johns Manville International, Inc., Denver, CO (US)

( * ) Notice: Subject to any disclaimer, the term of this patent is extended or adjusted under 35 U.S.C. 154(b) by 0 days.

(21) Appl. No.: 10/114,618

(22) Filed: Apr. 1, 2002

(65) Prior Publication Data

US 2003/0183055 A1 Oct. 2, 2003

(51) Int. Cl.[7] ..... B26D 7/08
(52) U.S. Cl. ..... 83/19; 83/176
(58) Field of Search ..... 83/19, 176, 332, 83/346, 676, 678, 425, 695, 14

(56) References Cited

U.S. PATENT DOCUMENTS

| | | | | |
|---|---|---|---|---|
| 2,335,968 A | | 12/1943 | Sawtell | |
| 3,152,501 A | * | 10/1964 | Nassar | 83/346 |
| 3,293,962 A | * | 12/1966 | Gianaris | 83/332 |
| 4,397,898 A | * | 8/1983 | Ray, Jr. | 428/43 |
| 4,756,945 A | | 7/1988 | Gibb | |
| 4,866,905 A | | 9/1989 | Bihy | |
| 5,024,131 A | * | 6/1991 | Weidman | 83/436.15 |
| 5,045,045 A | * | 9/1991 | Davenport et al. | 83/332 |
| 5,331,787 A | | 7/1994 | Paulitschke | |
| 5,545,453 A | | 8/1996 | Grant | |
| 5,567,504 A | | 10/1996 | Schakel | |
| 6,083,594 A | | 7/2000 | Weinstein | |
| 6,128,884 A | | 10/2000 | Berdan, II | |
| 6,165,305 A | | 12/2000 | Weinstein | |
| 6,484,463 B1 | * | 11/2002 | Fay | 52/404.4 |
| 6,551,677 B2 | * | 4/2003 | Weinstein et al. | 428/43 |
| 2003/0175466 A1 | * | 9/2003 | Bogrett et al. | 428/43 |

FOREIGN PATENT DOCUMENTS

| | | |
|---|---|---|
| DE | GM7830852 U1 | 1/1979 |
| DE | 3118597 A1 | 5/1981 |
| DE | 3203624 A1 | 4/1983 |
| DE | 3229601 A1 | 2/1984 |
| DE | 19700373 A1 | 2/1998 |
| DE | 29822362 U1 | 5/1999 |
| DE | 19914782 A1 | 10/2000 |

* cited by examiner

*Primary Examiner*—Stephen Choi
(74) *Attorney, Agent, or Firm*—Robert D. Touslee

(57) ABSTRACT

At least one longitudinally extending series of cuts and separable connectors is formed in a fibrous insulation blanket with one or more rotating compression-cutting blades and a cooperating anvil to form separable blanket sections in the insulation blanket. The size and configuration of the teeth and notches in the compression-cutting blade, which may be determined through the use of an empirical equation, insure that the insulation blanket has the integrity to be handled and installed as a unit, but can be separated by hand into the blanket sections. The anvil has a moving surface that drives the compression-cutting blade at the velocity blanket is being fed between the cutting blade and the anvil.

8 Claims, 4 Drawing Sheets

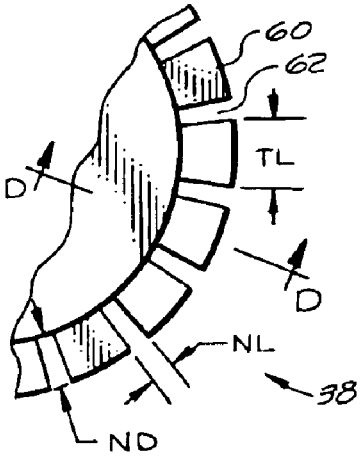
FIG. 12
FIG. 14
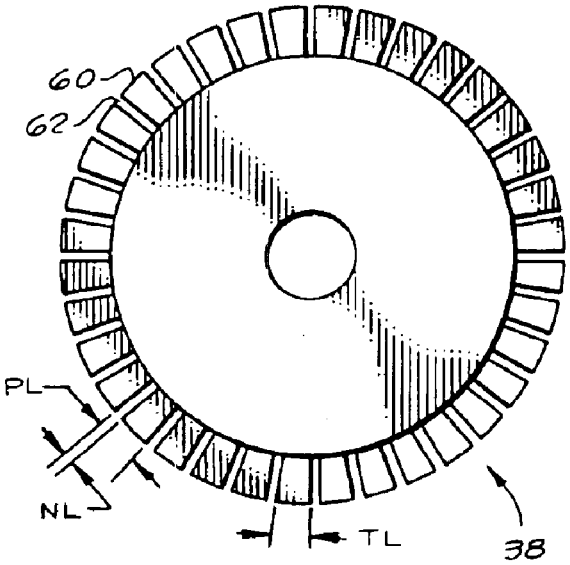
FIG. 15
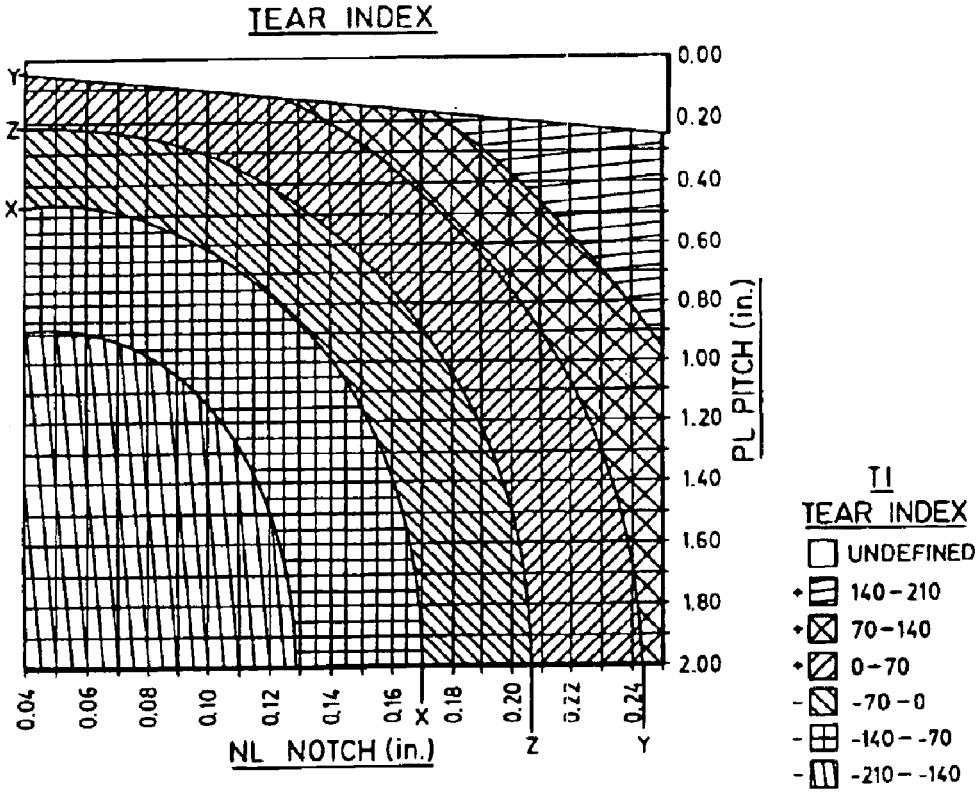

COMPRESSION-CUTTING ASSEMBLY AND METHOD

BACKGROUND OF THE INVENTION

The subject invention relates to a compression-cutting assembly for forming one or more longitudinally extending series of cuts and separable connectors in a fibrous insulation blanket so that the insulation blanket can be handled and installed as a unit or separated by hand along a longitudinally extending series of cuts and separable connectors into blanket sections having widths less than the insulation blanket and to a method of using the compression cutting assembly to form the one or more series of cuts and separable connectors in a fibrous insulation blanket. The invention includes the use of a unique compression-cutting blade and anvil assembly and a method of selecting the sizes of the teeth and notches in the compression-cutting blade that includes the use of an empirical equation.

Fibrous insulation blankets, such as glass fiber insulation blankets in batt or roll form are typically used to insulate the walls, ceiling, floors and roofs of homes and other residential building structures as well as for other similar insulating applications. A pre-cut fibrous insulation blanket and, in particular, a pre-cut resilient glass fiber insulation blanket has recently been developed which contains one or more longitudinally extending series of cuts and separable connectors that enable the insulation blanket to be handled and installed as a unit or separated by hand along a longitudinally extending series of cuts and separable connectors into blanket sections having widths less than the insulation blanket. These pre-cut fibrous insulation blankets enable insulation contractors to size the insulation blankets in width to insulate both standard width and narrower non-standard width building cavities formed by the framework of a building, such as external wall cavities of a residential building that are defined by the studs, without having to cut the insulation blankets in the field. By eliminating the need to cut the insulation blankets in the field, the pre-cut fibrous insulation blankets eliminate a safety hazard associated with the use of knives or other sharp cutting implements to cut insulation blankets in the field, greatly reduce the time required to insulate such cavities, and reduce unwanted scrap.

However, for best results, each series of longitudinally extending cuts and separable connectors formed in the insulation blanket should have separable connectors that have the integrity to hold the blanket sections together for handling and installation as a unit for insulating a standard width cavity while being readily tearable or separable, without the formation of tear outs, to enable the insulation blanket to be separated along one of the longitudinally extending cuts and separable connectors to form insulation blankets of lesser widths for insulating nonstandard width cavities. In addition, for ease of manufacture and for cost savings, the cutting assembly for forming each series of cuts and separable connectors in the fibrous insulation blanket should minimize damage to the separable connectors; not create excessive dust when cutting the fibers during the cutting operation, and minimize wear to the cutting assembly which would cause excessive down time.

SUMMARY OF THE INVENTION

The compression-cutting assembly of the subject invention and the method of using the compression-cutting assembly of the subject invention accomplish all of the objectives outlined in the preceding paragraph. The compression-cutting assembly of the subject invention includes a series of spaced apart circular compression-cutting blades and a cooperating moving anvil for forming at least one and, preferably a plurality of, longitudinally extending series of alternating cuts and separable connectors in a fibrous insulation blanket intermediate lateral edges of the fibrous insulation blanket. Each series of alternating cuts and separable connectors in the fibrous insulation blanket form the fibrous insulation blanket into separable blanket sections so that the fibrous insulation blanket can be handled and installed as a unit or easily separated by hand along a longitudinally extending series of alternating cuts and separable connectors into blankets having widths less than the width of the fibrous insulation blanket.

Each circular compression-cutting blade has an outer peripheral edge formed by a series of compression-cutting teeth separated by a series of notches. The lengths of the compression-cutting teeth and notches along the outer peripheral edge of each circular compression-cutting blade are selected to form each series of alternating cuts and separable connectors so that the separable connectors have the integrity to hold the blanket sections together for handling and installation as a unit while enabling the fibrous insulation blanket to be easily separated by hand along any of the series of alternating cuts and separable connectors to form blankets having a lesser width than the fibrous insulation blanket.

The moving anvil surface, along with conveyor belts that feed the fibrous insulation blanket to and remove the fibrous insulation blanket from the compression-cutting assembly, pass the fibrous insulation blanket between the compression-cutting blade(s) and the anvil at a selected velocity. The moving anvil surface not only provides a surface that cooperates with the compression-cutting teeth of the circular compression-cutting blade(s) to crush and cut the fibers of the fibrous insulation blanket, but also, through contact between the compression-cutting blade teeth and the moving anvil surface, drives the compression-cutting blade(s). With the moving anvil surface driving the compression-cutting blade(s) through contact between the compression-cutting blade teeth and the moving anvil surface, the compression-cutting blade(s) are rotated to move the outer peripheral edge(s) of the compression-cutting blade teeth at or substantially at the selected velocity of the moving anvil surface. With the outer peripheral edges of the compression-cutting blade teeth moving at or substantially at the same velocity as the fibrous insulation blanket when forming the one or more longitudinally extending series of alternating cuts and separable connectors in the fibrous insulation blanket, the blanket is not torn by a difference in velocity between the compression-cutting teeth and the fibrous insulation blanket. Preferably, the moving anvil surface that cooperates with the compression-cutting teeth of the compression-cutting blade(s) is the surface of either a cylindrical anvil or a continuous belt anvil.

In a preferred embodiment, each compression-cutting blade has an annular shoulder adjacent the bases of the notches and teeth to reduce the stresses otherwise generated in the separable connectors as a series of alternating cuts and separable connectors is being formed in the fibrous insulation blanket by compressing portions of the fibrous insulation blanket between the compression-cutting teeth and the moving anvil surface. In addition, to facilitate the formation of the cuts in the fibrous insulation blankets by the compression-cutting assembly, a blanket-compressing device can be used to compress the resilient fibrous insulation blankets and temporarily increase their density.

Through the use of an empirical equation, the subject invention also provides a method of selecting the relative sizes of the teeth and notches used in the circular compression-cutting blade(s) of the compression-cutting assembly of the subject invention that greatly simplifies the task of designing the circular compression-cutting blade(s) of the subject invention.

BRIEF DESCRIPTION OF THE DRAWINGS

FIG. 12 is an enlarged schematic view of the circled portion of FIG. 10.

FIG. 14 is a schematic side view of a compression-cutting blade used in the compression-cutting assembly of the subject invention schematically illustrating the terminology of the empirical equation that may be used to determine peripheral lengths of the teeth and notches for the compression-cutting blade.

FIG. 15 is a graph depicting the tear indexes for various notch lengths (NL) and pitch lengths (PL) of a compression-cutting blade.

DESCRIPTION OF THE PREFERRED EMBODIMENT

Figure 1:
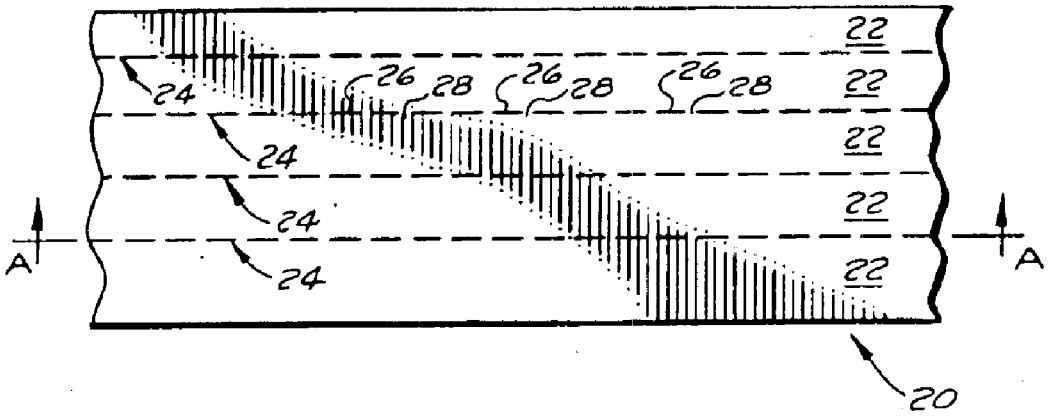
FIG. 1 is a top schematic view of a fibrous insulation blanket with a plurality of longitudinally extending, laterally spaced apart, series of cuts and separable connectors that form separable blanket sections in the fibrous insulation blanket.
Figure 2:
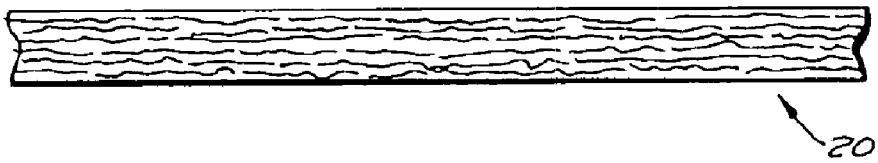
FIG. 2 is a side schematic view of the fibrous insulation blanket of FIG. 1.
Figure 3:
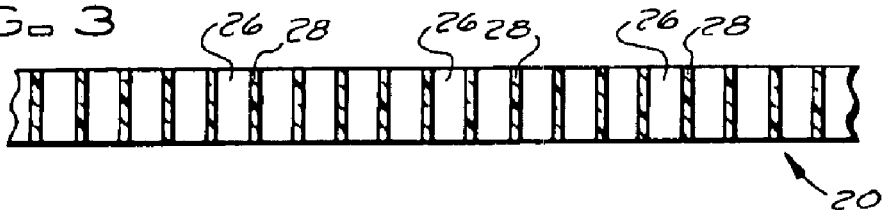
FIG. 3 is a longitudinally extending vertical schematic section through the fibrous insulation blanket of FIG. 1, taken substantially along lines A—A of FIG. 1.

FIGS. 1 to 3 show a typical pre-cut fibrous insulation blanket 20 formed by the compression-cutting assembly and method of the subject invention. While the pre-cut fibrous insulation blanket 20 may be made of other fibrous materials, preferably, the pre-cut fibrous insulation blanket is made of randomly oriented, entangled, glass fibers and typically has a density between about 0.3 pounds/ft$^3$ and about 1.6 pounds/ft$^3$. Preferably, the fibrous insulation materials used to form the pre-cut fibrous insulation blanket 20, whether made of glass or other fibers, are sufficiently resilient to permit the compression of the blanket to temporarily increase its density during the compression cutting operation and to close the longitudinally extending series of discontinuous cuts made in the fibrous insulation blanket that both: a) divide the fibrous insulation blanket into longitudinally extending blanket sections of selected widths; and b) by not completely severing the fibrous insulation blanket between adjacent blanket sections, form separable connectors within the fibrous insulation blanket separably joining adjacent blanket sections. With this resilient structure, the cuts in the pre-cut fibrous insulation blanket do not form thermal bridges in the direction of the thickness of the blanket (perpendicular to the major surfaces of the blanket) that might adversely affect the thermal and/or acoustical performance or other properties of the pre-cut fibrous insulation blanket.

Examples of other fibers that may be used to form the pre-cut fibrous insulation blanket are mineral fibers, such as but not limited to, rock wool fibers, slag fibers, and basalt fibers, and organic fibers such as but not limited to polypropylene, polyester and other polymeric fibers. The fibers in the pre-cut fibrous insulation blanket may be bonded together for increased integrity, e.g. by a binder at their points of intersection such as but not limited to urea phenol formaldehyde or other suitable bonding materials, or the pre-cut fibrous insulation blanket may be binder-less provided the blanket possesses the required integrity and resilience.

Due to its resilience, the preferred pre-cut resilient fibrous insulation blanket 20 can be compressed to reduce the blanket in thickness for packaging. When the pre-cut resilient fibrous insulation blanket is removed from the insulation package, the blanket recovers to substantially its pre-compressed thickness. However, the resilience of the pre-cut resilient fibrous insulation blanket provides another very important benefit. After a full width pre-cut resilient fibrous insulation blanket or a reduced width resilient fibrous insulation blanket formed from the full width pre-cut resilient fibrous insulation blanket is compressed in width and inserted into a cavity having a width somewhat less than the width of the full width pre-cut resilient fibrous insulation blanket or reduced width resilient fibrous insulation blanket, the full width pre-cut resilient fibrous insulation blanket or reduced width resilient fibrous insulation blanket will expand laterally to the width of the cavity and press against the sides of the cavity to hold or help hold the pre-cut resilient fibrous insulation blanket or reduced width resilient fibrous insulation blanket in place.

Preferably, full width pre-cut resilient glass fiber insulation blankets and reduced width glass fiber insulation blankets formed by the compression-cutting assembly and/or method of the subject invention have a density between about 0.3 pcf to about 1.6 pcf; can be compressed laterally up to between 1.0 and 3.0 inches; and will expand laterally to resiliently engage the sidewalls of cavity. The full width pre-cut resilient glass fiber insulation blankets and reduced width resilient glass fiber insulation blankets of the subject invention having a density between about 0.3 pcf to about 1.0 pcf can be compressed laterally between 2.0 and 3.0 inches without appreciably adversely affecting the thermal and/or acoustical performance of the insulation blanket. However, the higher density full width pre-cut resilient glass fiber insulation blankets and reduced width resilient glass fiber insulation blankets of the subject invention having a density between about 1.0 pcf and about 1.6 pcf may exhibit some reduction in thermal and/or acoustical performance when compressed laterally a distance greater than 1 to 2 inches.

While the pre-cut fibrous insulation blankets formed by the compression-cutting assembly and/or method of the subject invention may be in roll form, for most applications, such as the insulation of walls in homes and other residential structures, the pre-cut resilient fibrous insulation blankets are in the form of batts about 46 to about 59 inches in length (typically about 48 inches in length) or 88 to about 117 inches in length (typically about 93 inches in length). Typically, the widths of the pre-cut resilient fibrous insulation blankets are substantially equal to or somewhat greater than standard cavity width of the cavities to be insulated, for example: about 15 to about 15½ inches in width (a nominal width of 15 inches) for a cavity where the center to center spacing of the wall, floor, ceiling or roof framing members is about 16 inches (the cavity having a width of about 14½ inches); and about 23 to about 23½ inches in width (a nominal width of 23 inches) for a cavity where the center to center spacing of the wall, floor, ceiling or roof framing members is about 24 inches (the cavity having a width of about 22½ inches). However, for other applications, the pre-cut resilient fibrous insulation blankets may have different initial widths determined by the standard widths of the cavities to be insulated by the insulation blankets.

The thicknesses of the pre-cut fibrous insulation blankets formed by the compression-cutting assembly of the subject invention are typically determined by the amount of thermal resistance or sound control desired and the depth of the cavities being insulated. Typically, the pre-cut fibrous insulation blankets are about three to about fourteen or more inches in thickness and approximate the depth of the cavities being insulated. For example, in a wall cavity defined in part by nominally 2×4 or 2×6 inch studs or framing members, a pre-cut resilient fibrous insulation blanket will have a thickness of about 3½ inches or about 5½ inches, respectively.

The preferred pre-cut resilient fibrous insulation blanket 20 formed by the compression-cutting assembly and/or method of the subject invention includes a plurality of longitudinally extending blanket sections, e.g. 5 blanket sections 22, formed in the resilient fibrous insulation blanket 20 by a plurality of longitudinally extending series 24 of alternating cuts 26 and separable connectors 28 located intermediate the blanket sections 22 of the resilient fibrous insulation blanket 20. Each longitudinally extending series 24 of alternating cuts and separable connectors is spaced laterally from each other longitudinally extending series 24 of cuts and separable connectors and laterally inward from the lateral edges of the resilient fibrous insulation blanket. The separable connectors 28 of each series 24 of the cuts and separable connectors separably join the adjacent blanket sections 22 of the pre-cut resilient fibrous insulation blanket along the length of the resilient fibrous insulation blanket 20 to hold the resilient fibrous insulation blanket together for handling and installation while being easily separable by hand to permit selective separation of adjacent blanket sections 22 to form a reduced width resilient fibrous insulation blanket of a desired or selected width.

Figure 4:
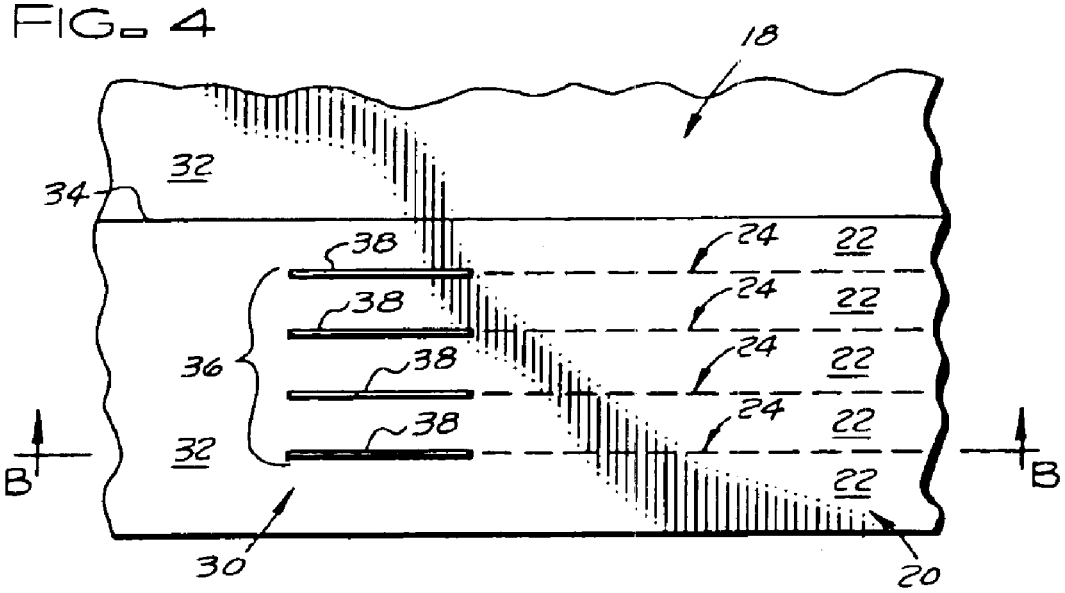
FIG. 4 is a schematic plan view of the compression-cutting assembly of the subject invention.

FIG. 4 schematically shows a compression-cutting assembly 30 in a production line compression-cutting a fibrous insulation blanket 32 (normally a standard width fibrous insulation blanket that is nominally 15 or 23 inches wide) to form the pre-cut fibrous insulation blanket 20. These standard width fibrous insulation blankets 32 are formed from a wider fibrous insulation blanket by completely severing the wider fibrous insulation blanket longitudinally along cuts such as cut 34. There are typically four or more standard width fibrous insulation blankets 32 formed from the wider fibrous insulation blanket with every second blanket being compression-cut by a compression-cutting assembly 30 to form a pre-cut fibrous insulation blanket 20 while the intermediate blankets 32 remain uncut to form conventional uncut resilient fibrous insulation blankets 18.

Figure 5:
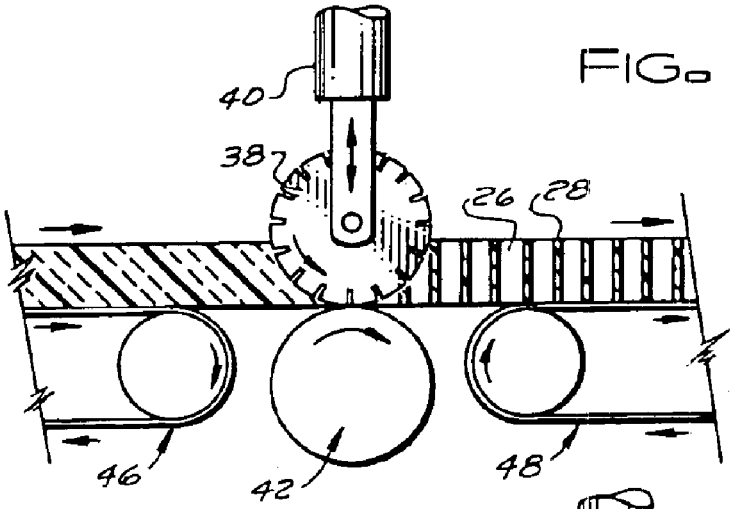
FIG. 5 is a schematic vertical section through the compression-cutting assembly of FIG. 4 taken substantially along lines B—B of FIG. 4 and showing the compression-cutting assembly of FIG. 4 equipped with a cylindrical anvil.
Figure 6:
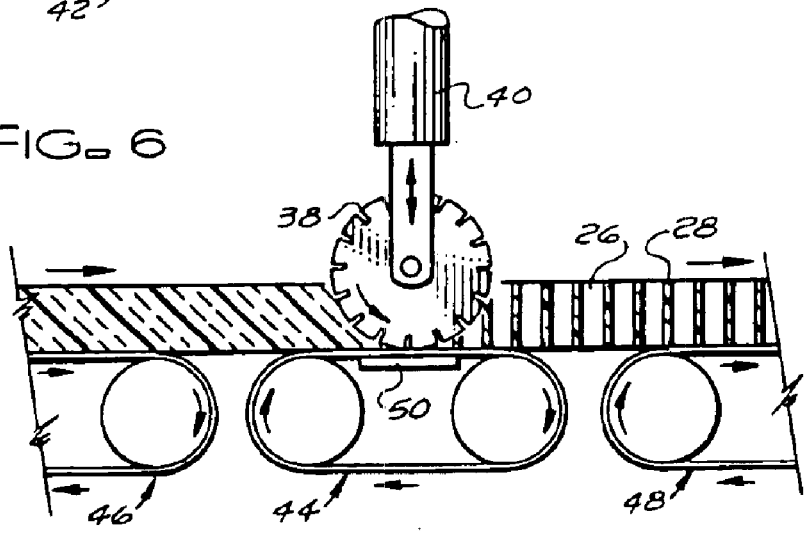
FIG. 6 is a schematic vertical section through the compression-cutting assembly of FIG. 4 taken substantially along lines B—B of FIG. 4 and showing the compression-cutting assembly of FIG. 4 equipped with a continuous belt anvil.

As shown in FIGS. 4 to 6, each compression-cutting assembly 30 includes a set 36 of spaced apart circular compression-cutting blades 38 and an anvil, such as anvil 42 or 44, with a moving anvil surface. In each compression-cutting assembly 30, the moving anvil surface cooperates with the compression-cutting teeth of the circular compression-cutting blades 38 to crush and cut the fibers of one of the fibrous insulation blankets 32 to form one or more longitudinally extending series 24 of cuts and separable connectors in the blanket 32 and thereby make a pre-cut fibrous insulation blanket 20. The moving anvil surface in each compression-cutting assembly 30 not only provides a surface which cooperates with the compression-cutting teeth of the compression-cutting blades 38 to form at least one and, preferably, a plurality of the longitudinally extending, laterally spaced apart, series 24 of alternating cuts 26 and separable connectors 28 in each of the fibrous insulation blankets 32, but also drives the compression-cutting blades 38 of each set 36 of compression-cutting blades.

The spaced apart circular compression-cutting blades 38 are spaced apart across the widths of the fibrous insulation blankets 32 at locations selected to form blanket sections 22 of desired widths in each of the fibrous insulation blankets 32 being formed into a pre-cut fibrous insulation blanket 20. Preferably, the circular compression-cutting blades 38 are each rotatably mounted on a separate pneumatic piston assembly 40 that permits the compression-cutting blades 38 to be pressed against the moving anvil surface of the anvil with a selected pressure to effect the compression-cutting of the blanket 32 and drive the compression-cutting blades 38. As schematically shown in FIGS. 5 and 6, the pneumatic piston assemblies 40 are used to move the compression-cutting blades 38 toward and away from the moving anvil surface to adjust the pressure with which the blades are pressed against the moving anvil surface. By driving each circular compression-cutting blade 38 with the moving anvil surface, the compression-cutting teeth at the underside of each circular compression-cutting blade 38 are moving in the same direction as the fibrous insulation blankets 32 at the same or substantially the same linear velocity as the blanket 32.

Preferably, anvils that cooperate with the compression-cutting teeth of the compression-cutting blades 38 to crush and cut the fibers of the fibrous insulation blankets 32 and to drive the compression-cutting blades are either driven rotating cylindrical anvils such as the anvil 42 of FIG. 5 or moving continuous belt anvils such as the belt anvil 44 of FIG. 6. The conveyor belts 46 and 48 that feed the fibrous insulation blankets 32 to and remove both the pre-cut fibrous insulation blankets 20 from the compression-cutting assemblies 30 move at the same or substantially the same linear velocity as the moving anvil surfaces of the anvils 42 or 44 and outer peripheral edges of the compression-cutting teeth of the compression-cutting blades 38. Thus, with the linear peripheral velocity of the compression-cutting teeth of the compression-cutting blades 38 and the linear velocity of the fibrous insulation blanket 32 equal or substantially equal, the blanket is not torn by a difference in velocity between the compression-cutting teeth and the fibrous insulation blanket.

Each of the moving continuous belt anvils 44 may have a backing plate 50 opposite the compression-cutting blades 38 to provide a firm anvil surface opposite the compression cutting teeth of the compression-cutting blades 38 and enhance the crushing and cutting of the blanket fibers by the teeth of the compression cutting blades 38. The anvils 42 and 44 may have an elastomeric anvil surface, preferably urethane, which exhibits a durometer hardness between 60A and 80D.

The compression-cutting assemblies 30 work more effectively when the resilient fibrous insulation blankets 32 are compressed in thickness to make the resilient fibrous insulation blankets denser. Accordingly, one embodiment of the compression-cutting assemblies 30, shown in FIGS. 7 to 9, includes a metal blanket compression plate 52 to compress the resilient fibrous insulation blankets 32 from their normal uncompressed thickness, e.g. an uncompressed thickness from 1 inch to 14 inches, to a compressed thickness between 1 inch and 7 inches.

As shown, the blanket compression plate 52 of each compression-cutting assembly 30 includes a leading or upstream portion 54 and an integral trailing or downstream portion 56. Preferably, the leading or upstream portion 54 of the blanket compression plate 52 is planar or substantially planar and extends entirely across the width of the resilient fibrous insulation blanket 32 being compression-cut by the compression-cutting assembly. The leading or upstream portion 56 of the blanket compression plate 52 also extends upstream and upward from the trailing or downstream portion 56 of the blanket compression plate 52, at an acute angle to the upper major surfaces of the incoming resilient fibrous insulation blankets 32, to a height greater than any normal thickness for the resilient fibrous insulation blankets being compression cut. Typically, the acute angle of the upstream portion 54 of the blanket compression plate 52 to the major surfaces of the incoming resilient fibrous insulation blankets 32 is between 30° and 60°.

Figure 7:
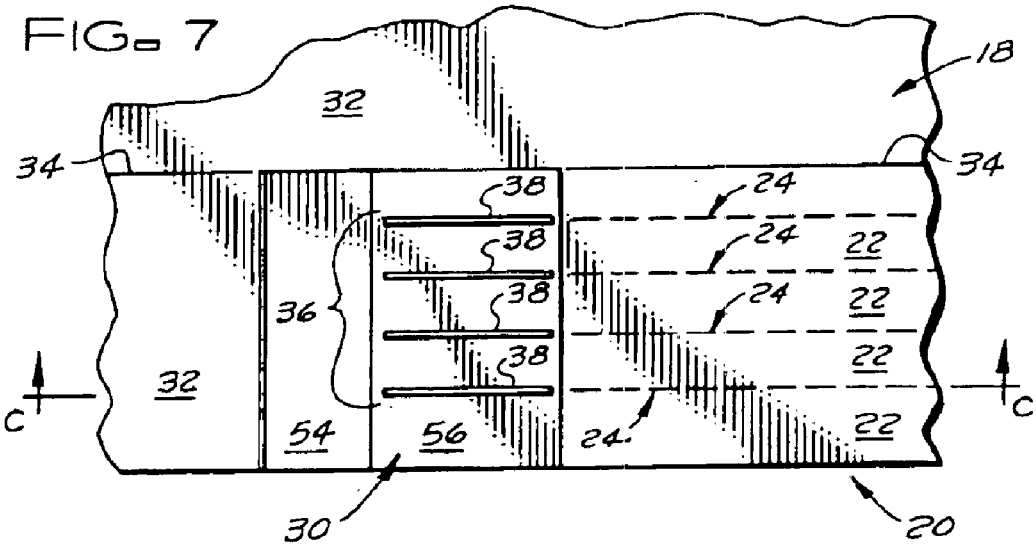
FIG. 7 is a schematic plan view of the compression-cutting assembly of the subject invention that is equipped with a blanket compression device.
Figure 8:
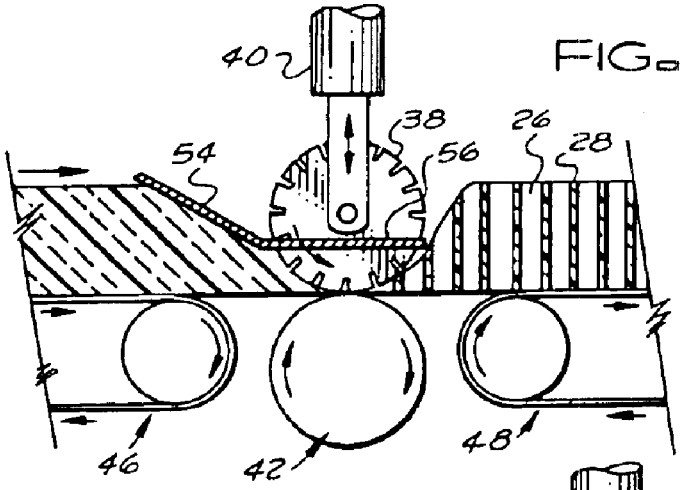
FIG. 8 is a schematic vertical section through the compression-cutting assembly of FIG. 7 taken substantially along lines C—C of FIG. 7 and showing the compression-cutting assembly of FIG. 7 equipped with a cylindrical anvil.
Figure 9:
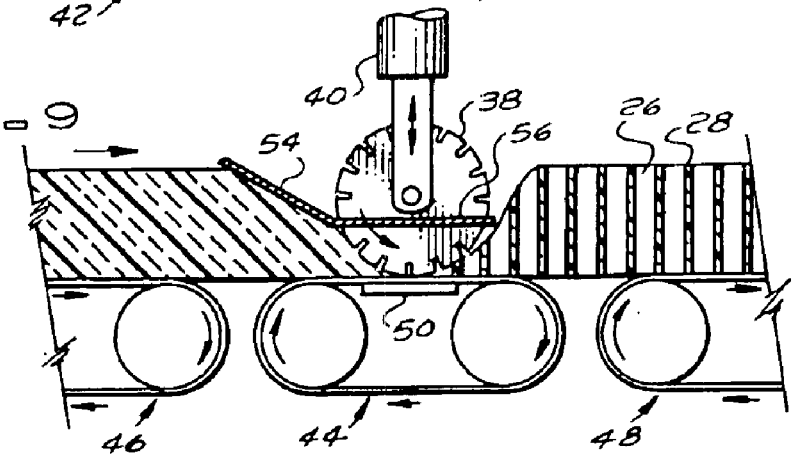
FIG. 9 is a schematic vertical section through the compression-cutting assembly of FIG. 7 taken substantially along lines C—C of FIG. 7 and showing the compression-cutting assembly of FIG. 7 equipped with a continuous belt anvil.
Figure 10:
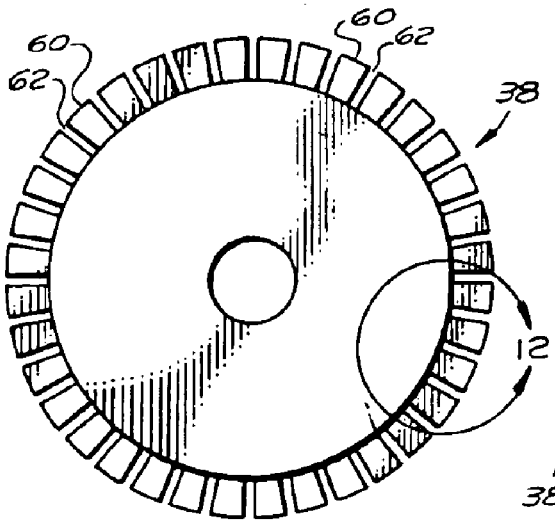
FIG. 10 is a schematic side view of a compression-cutting blade used in the compression-cutting assembly of the subject invention.
Figure 11:
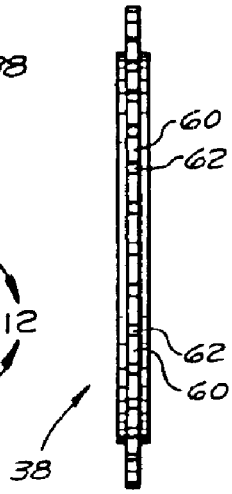
FIG. 11 is a schematic edge view of the compression-cutting blade of FIG. 10.
Figure 13:
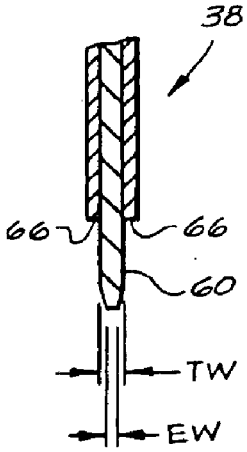
FIG. 13 is schematic section through the compression-cutting blade of FIG. 12, taken substantially along lines D—D of FIG. 12.

Preferably, the trailing portion 56 of the blanket compression plate 52 is planar or substantially planar and extends across the width the resilient fibrous insulation blanket 32 being compression-cut by the compression-cutting assembly 30 in a plane parallel to or substantially parallel to the upper and lower major surfaces of the resilient fibrous insulation blankets. The trailing portion 56 contains a slit or elongated opening for each of the compression-cutting blades 38 and the lower portions of the compression-cutting blades 38 extend through the slits or elongated openings to crush and cut, in cooperation with the moving anvil surface, the fibers of the resilient fibrous insulation blankets 32 being formed into the pre-cut resilient fibrous insulation blankets 20. Preferably, the height of the trailing portion 56 of the blanket compression plate 52 above the moving anvil surface is adjustable to enable resilient fibrous insulation blankets 32 of various thicknesses and densities to be selectively compressed to a most effective thickness for the compression-cutting of the resilient fibrous insulation blankets 32 by the compression-cutting assembly 30. Other than the inclusion of the blanket compression plate 52, the compression-cutting assembly 30 of FIGS. 7 to 9 is the same as the compression-cutting assembly 30 of FIGS. 4 to 6.

FIGS. 10 to 13 schematically illustrate a preferred embodiment of the compression-cutting blade 38. The preferred compression-cutting blade is made of heat-treated carbon steel and has an outer diameter between 8 inches and 42 inches. The compression-cutting teeth 60 and notches 62 of the preferred embodiment of the compression-cutting blade 38 are uniform in circumferential length and depth. The preferred circumferential lengths "TL" of the teeth 60 are between 0.2 inches and 2.0 inches. The preferred circumferential lengths "NL" of the notches 62 are between 0.04 inches and 0.25 inches. The preferred depths "ND" of the notches 62 are between 0.25 inches and 1.75 inches. The preferred teeth 60 have a width "TW" between 0.060 inches and 0.187 inches and crushing and cutting edges 64 that are flat with a width "EW" between 0.001 inches and 0.020 inches. The flat crushing and cutting edges of the teeth allow the effective crushing and cutting of the fibers in the blanket without causing excessive damage to the anvil surface or excessive dust from the crushing action of the teeth. In addition, the preferred embodiment of the compression-cutting blade 38 includes annular shoulders 66 on each side of the compression-cutting blade. The annular shoulders 66 extend laterally outward from the bases of the teeth 60 and notches 62 of the compression-cutting blade between 0.032 inches and 0.5 inches (preferably between 0.08 inches and 0.5 inches) and extend annularly along or adjacent the bases of the teeth 60 and notches 62. The annular shoulders 66 of the blades 38 prevent damage to the separable connectors 24 during the formation of the cuts 22 and separable connectors 24 by the compression-cutting assembly 30 by reducing the stresses generated in the resilient fibrous insulation blankets 32 at the bases of the notches 62 during the crushing and cutting process.

Referring now to the compression-cutting blade 38 of FIG. 14 and the tear index graph of FIG. 15, a method of the subject invention for selecting the arcuate lengths of the compression-cutting teeth 60 (for teeth between 0.2 to 1.96 inches in arcuate length) and notches 62 (for notches between 0.04 and 0.25 inches in arcuate length) along a peripheral edge of a circular compression-cutting blade 38 includes the use of an empirical equation. The empirical equation provides a tear index "TI" that indicates the ease with which a pre-cut fibrous insulation blanket 20 can be separated by hand along a series 24 of cuts and separable connectors while retaining the required integrity for the normal handling and installation of the pre-cut fibrous insulation blanket as a unit. The preferred tear index value is or approximates 0. However, for tear index values between −70 and +70, the pre-cut fibrous insulation blanket 20 can still be easily separated along a series 24 of cuts and separable connectors while retaining the required integrity for the normal handling and installation of the pre-cut fibrous insulation blanket 20 as a unit. Thus, a compression-cutting blade 38, made with compression-cutting teeth and notches having circumferential tooth and notch lengths determined according to the method of the subject invention, makes a longitudinally extending series 24 of cuts 26 and separable connectors 28 in a fibrous insulation blanket so that the blanket can be handled and installed as a unit or easily separated by hand at the longitudinally extending series 24 of cuts and separable connectors into blanket sections having widths less than a width of the fibrous insulation blanket. The method includes:

a) selecting a notch length NL for each of the notches in inches;

b) selecting a tooth length TL for each of the teeth in inches;

c) adding the notch length NL and tooth length TL to obtain a pitch length PL in inches;

d) inserting the notch length NL and the pitch length PL in the following empirical equation for finding a tear index TI:

$$TI=74.65-1330.4\times NL-298.38\times PL+15738\times NL^2+112.43\times PL^2-25080\times NL^3-12.903\times PL^3;$$

e) solving for TI; and f) where the TI is between −70 and +70, using the selected notch length and tooth length for the circular compression-cutting blade.

The tear index graph of FIG. 15 is generated from the empirical tear index equation set forth in the preceding paragraph. In the tear index graph of FIG. 15, a circular compression-cutting blade 38, having notch lengths NL and pitch lengths PL falling within the area defined between the lines X—X and Y—Y (extending approximately from notch lengths 0.17 and 0.242) forms a series 24 of cuts and separable connectors in the fibrous insulation blanket 32 that enable the pre-cut fibrous insulation blanket 20 to be handled and installed as a unit or easily separated by hand at the longitudinally extending series 24 of cuts and separable connectors into blanket sections having widths less than a width of the fibrous insulation blanket. A circular compression-cutting blade 38, having notch lengths and pitch lengths falling on the line Z—Z (extending from the notch length 0.206 substantially parallel to lines X—X and Y—Y) forms the best compression-cutting blades 38. The notch length NL cannot be greater than the pitch length PL and accordingly, for the portion of the tear index graph of FIG. 15 labeled "undefined" the selected notch lengths NL and pitch lengths PL are unsuited for defining the arcuate lengths of the notches and the pitches.

The following analysis shows the regression statistics for the tear index equation:

$$TI=74.65-1330.4\times NL-298.38\times PL+15738\times NL^2+112.43\times PL^2-25080\times NL^3-12.903\times PL^3.$$

| Predictor | Coefficient | SE Coefficient | NL | PL |
|---|---|---|---|---|
| Constant | 74.65 | 35.46 | 2.10 | 0.040 |
| NL | −1330.4 | 997.9 | −1.33 | 0.188 |
| PL | −298.38 | 37.72 | −7.91 | 0.000 |
| NL Squared | 15738 | 7757 | 2.03 | 0.047 |
| PL Squared | 112.43 | 23.29 | 4.84 | 0.000 |
| NL Cubed | −25080 | 18025 | −1.39 | 0.170 |
| PL Cubed | −12.903 | 4.013 | −3.22 | 0.002 |

S=32.19 R-Sq=79.9% R-Sq (adj)=77.6%

Analysis of Variance

| Source | DF | SS | MS | F | P |
|---|---|---|---|---|---|
| Regression | 6 | 221751 | 36958 | 35.67 | 0.000 |
| Residual Error | 54 | 55954 | 1036 | | |
| Total | 60 | 277705 | | | |
| Source | DF | Seq. SS | | | |
| NL | 1 | 47675 | | | |
| PL | 1 | 51438 | | | |
| NL Squared | 1 | 41558 | | | |
| PL Squared | 1 | 68913 | | | |
| NL Cubed | 1 | 1454 | | | |
| PL Cubed | 1 | 10712 | | | |

Unusual Observations

| Obs | NL | Index | Fit | SE Fit | Residual | St Residual |
|---|---|---|---|---|---|---|
| 18 | 0.040 | 100.00 | 24.67 | 11.00 | 75.33 | 2.49R |
| 23 | 0.040 | 100.00 | 24.67 | 11.00 | 75.33 | 2.49R |
| 26 | 0.040 | −50.00 | 10.80 | 10.67 | −60.80 | −2.00R |
| 27 | 0.040 | −100.00 | 5.40 | 10.62 | −105.40 | −3.47R |
| 28 | 0.100 | 100.00 | 23.76 | 9.69 | 76.24 | 2.48R |
| 37 | 0.140 | −100.00 | −92.40 | 23.44 | −7.60 | −0.34x |
| 48 | 0.230 | 100.00 | 75.60 | 23.64 | 24.40 | 1.12x |
| 49 | 0.270 | 100.00 | 137.42 | 26.81 | −37.42 | −2.10RX |

"R" denotes an observation with a large standardized residual.
"X" denotes an observation whose X value gives it large influence.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A method of forming at least one longitudinally extending series of cuts and separable connectors in a fibrous insulation blanket intermediate lateral edges of the fibrous insulation blanket to form separable blanket sections in the fibrous insulation blanket so that the fibrous insulation blanket can be handled and installed as a unit or separated by hand along the longitudinally extending series of cuts and separable connectors into blanket sections having widths less than a width of the fibrous insulation blanket, comprising:

providing a fibrous insulation blanket having a density between 0.3 pounds/ft3 and 1.6 pounds/ft$^3$, a width, and a thickness of at least one inch;

providing at least one circular compression-cutting blade; the circular compression-cutting blade having an outer peripheral edge formed by a series of compression cutting teeth separated by a series of notches; the compressing cutting teeth each having an arcuate length at the outer peripheral edge of the first circular compression-cutting blade between 0.2 inches and 2.0 inches; the notches each having an arcuate length at the outer peripheral edge of the circular compression-cutting blade between 0.04 inches and 0.25 inches; the notches having a depth from a base of the notch to the outer peripheral edge of the first circular compression-cutting blade between 0.5 inches and 1.75 inches; the circular compression-cutting blade having a pair of annular shoulders on lateral surfaces of the circular compression-cutting blade that project laterally outward from adjacent the bases of the notches;

using the annular shoulders on the lateral surfaces of the circular compression-cutting blade to reduce the stresses generated in the fibrous insulation blanket at the bases of the notches of the compression-cutting blade as the fibrous insulation blanket is being cut by the circular compression cutting blade to thereby reduce damage to the separable connectors being formed in the fibrous insulation blanket from high compression stresses that would otherwise be set up in the fibrous insulation blanket at the bases of the notches during the cutting of the fibrous insulation blanket with the circular compression-cutting blade;

providing an anvil with an anvil surface moving at a selected velocity for cooperating with the compression cutting teeth of the circular compression-cutting blade to cut the fibrous insulation blanket;

feeding the fibrous insulation blanket between the circular compression-cutting blade and the anvil at substantially the selected velocity of the moving anvil surface; and rotating the circular compression-cutting blade to move the outer peripheral edge of the circular compression-cutting blade at substantially the selected velocity of the moving anvil surface whereby the outer peripheral edges of the compression-cutting teeth of the circular compression-cutting blade move at substantially the selected velocity of the moving anvil surface and form a longitudinally extending series of cuts and separable connectors in the fibrous insulation blanket between first and second longitudinally extending blanket sections that are separable from each other along the longitudinally extending series of cuts and separable connectors formed in the fibrous insulation blanket.

2. The method of forming at least one longitudinally extending series of cuts and separable connectors in a fibrous insulation blanket according to claim 1 wherein:

the circular compression-cutting blade is rotated to move the outer peripheral edge of the first circular compression-cutting blade at the selected velocity of the moving anvil surface, through contact of the compression-cutting teeth of the compression-cutting blade with the moving anvil surface.

3. The method of forming at least one longitudinally extending series of cuts and separable connectors in a fibrous insulation blanket according to claim 2, wherein:

the anvil is a driven cylindrical roller.

4. The method of forming at least one longitudinally extending series of cuts and separable connectors in a fibrous insulation blanket according to claim 2 wherein:

the anvil is a driven continuous belt.

5. The method of forming at least one longitudinally extending series of cuts and separable connectors in a fibrous insulation blanket according to claim 1, wherein:

the compression cutting teeth of the circular compression-cutting blade each have a cutting edge; and the cutting edge of each of the compression cutting teeth has a width of between 0.001 inches and 0.020 inches to reduce damage to the anvil while keeping dust produced through the crushing action of the compression cutting teeth at an acceptable level; and the circular compression-cutting blade has an outer diameter between 8 inches and 42 inches.

6. The method of forming at least one longitudinally extending series of cuts and separable connectors in a fibrous insulation blanket according to claim 1, including:

pre-compressing the fibrous insulation blanket prior to passing the fibrous insulation blanket between the circular compression-cutting blade and the anvil and maintaining the fibrous insulation blanket in a compressed state while passing the fibrous insulation blanket between the circular compression-cutting blade and the anvil.

7. The method of forming at least one longitudinally extending series of cuts and separable connectors in a fibrous insulation blanket according to claim 6, wherein:

the fibrous insulation blanket provided is between 1 inch and 14 inches in thickness and the fibrous insulation blanket is compressed to a thickness between 1 inch and 7 inches.

8. The method of forming at least one longitudinally extending series of cuts and separable connectors in a fibrous insulation blanket according to claim 1, including:

providing a plurality of the circular compression-cutting blades spaced laterally with respect to each other across the width of the fibrous insulation blanket and the plurality of the compression-cutting blades being rotated by the moving anvil surface at the selected velocity of the moving anvil surface for forming a plurality of the longitudinally extending series of cuts and separable connectors in the fibrous insulation blanket that are spaced laterally with respect to each other across the width of the fibrous insulation blanket.

* * * * *